US007278802B2

(12) United States Patent
Bisson et al.

(10) Patent No.: US 7,278,802 B2
(45) Date of Patent: Oct. 9, 2007

(54) DEVICE FOR RAISING AND SUPPORTING THE FOUNDATION OF A BUILDING

(75) Inventors: Raymond Bisson, Carignan (CA); Alain Gagnon, St. Hubert (CA); Claude Boucher, St. Hubert (CA); Yvonick Houde, Montreal (CA)

(73) Assignee: Roger Bisson Inc., Saint-Hubert (CA)

( * ) Notice: Subject to any disclaimer, the term of this patent is extended or adjusted under 35 U.S.C. 154(b) by 243 days.

(21) Appl. No.: 11/082,952

(22) Filed: Mar. 18, 2005

(65) Prior Publication Data

US 2005/0220544 A1 Oct. 6, 2005

(30) Foreign Application Priority Data

Mar. 19, 2004 (CA) ..... 2461493

(51) Int. Cl.
*E02D 27/50* (2006.01)

(52) U.S. Cl. ..... 405/230; 405/244

(58) Field of Classification Search ..... 405/230, 405/232

See application file for complete search history.

(56) References Cited

U.S. PATENT DOCUMENTS 4,765,777 A 8/1988 Gregory
4,925,345 A 5/1990 McCown, Jr.
5,116,355 A 5/1992 Freeman, III
5,123,209 A 6/1992 Nally
5,246,311 A 9/1993 West et al.
6,193,442 B1 2/2001 May
6,416,255 B1 7/2002 Carlson

FOREIGN PATENT DOCUMENTS

CA 2031041 4/1996

*Primary Examiner*—Tara L. Mayo
(74) *Attorney, Agent, or Firm*—Goudreau Gage Dubuc

(57) ABSTRACT

A device and a method for raising and supporting the foundation of a building, using a mobile assembly comprising facing jaws and an arm pivotable between a first position where an area between the facing jaws is open and a second position where this area is closed, actuating means adapted to draw the mobile assembly driving a pile secured between the facing jaws when the arm is in the second position, downwardly in the ground, the pile being made of a series of pile sections that are connected together. A pile section that needs to be added to the pile is front-loaded into position atop the pile and between the facing jaws when the arm is in the first position.

28 Claims, 12 Drawing Sheets

DEVICE FOR RAISING AND SUPPORTING THE FOUNDATION OF A BUILDING

FIELD OF THE INVENTION

The present invention relates to devices for lifting the foundations of a building, more particularly by driving piers or piles into the ground and fixing these piles to the foundations once the building has been raised to a desired level.

BACKGROUND OF THE INVENTION

When a building's foundations have sunk into the ground, it is often desirable, if not necessary, to raise these foundations so that the building is returned to a level attitude.

Canadian Patent No. 2,031,041 issued on Apr. 16, 1996 discloses such a device for raising the foundations of a building using piles that are then secured to the foundations to maintain the latter at a level position. More particularly, in this Canadian Patent, an L-shaped lifting assembly 5 is inserted under the foundation of the building and is bolted to the concrete thereof, as seen by the horizontal support 24 located under the foundation's footing 2 and by the bolts 23 that extend through holes 22 of the lifting assembly 5. The lifting assembly 5 also includes a vertical tubular member 19 with a pile 6, as seen in FIG. 2, being slidable vertically longitudinally therethrough.

The pile 6 is made of a series of pile sections, such as items 10 and 11 of FIG. 2 of the Canadian Patent, which are connected together via inserts 15 as the pile is driven gradually into the ground. The pile 6 is driven into the ground via a jaw assembly 7 that includes two pivotal jaws 33 and 35 that are positioned on opposite sides of the pile 6. A pair of hydraulic cylinders 8 and 9 connects the lower lifting assembly 5 to the upper jaw assembly 7.

When the cylinders 8 and 9 are extended, the jaws 34 and 35 are adapted to pivot so as to enable the jaw assembly 7 to slide upwardly over and along the pile 6. When the cylinders 8 and 9 are subsequently retracted, the jaws 34 and 35 are adapted to pivot so as to firmly grasp the pile 6 and drive the same into the soil. Repeated extensions and retractions of the cylinders cause the pile 6 to be gradually driven into the soil. When the lower end 13 of the lowermost pile section of the pile 6 reaches solid ground, further retraction of the cylinders 8 and 9 causes the lifting assembly 5 to raise along with the foundation, as the pile 6 cannot itself further displace downwardly.

When the foundation has been sufficiently raised (e.g. the building is now level), the pile 6 and the tubular member 19 are welded together to retain the foundation in the desired position. The jaw assembly 7 and the cylinders 8 and 9 are then removed.

Generally, pile sections 10 and 11 are gradually added to the pile instead of having a single unitary very long pile 6. This becomes necessary when the operation is done from inside of a building where a ceiling limits the length of the pile 6 and forces the same to be made of a series of initially separate pile sections that are gradually connected together in a successive and longitudinal manner, thereby forming the pile 6.

U.S. Pat. No. 6,193,442-B1 issued on Feb. 27, 2001 to May discloses another device for raising and supporting a building foundation via a lifting assembly that includes a bracket adapted to be secured to the base of the foundation, a pier adapted to be driven into the ground until it reaches a layer bedrock, and a support for the pier, which is secured to the bracket and through which the pier extends. A pair of shafts secures a pier plate and a hydraulic plate to the pier support with the pier plate resting atop the pier. A hydraulic jack is positioned on top of the pier plate. The hydraulic plate being rigidly secured to the shafts, when the hydraulic jack is actuated, it forces the pier plate down, as it is held in fixed position by the hydraulic plate, thereby gradually driving the pier into the ground. The hydraulic jack that drives the pier into the ground is located atop the pier and acts downwardly thereon. A separate jack is used to then lift the foundation.

Other systems are disclosed in U.S. Pat. No. 5,246,311 issued on Sep. 21, 1993 to West et al., U.S. Pat. No. 5,123,209 issued on Jun. 23, 1992 to Nally, U.S. Pat. No. 4,765,777 issued on Aug. 23, 1998 to Gregory, U.S. Pat. No. 4,925,345 issued on May 15, 1990 to McCown, Jr. et al., U.S. Pat. No. 6,416,255-B1 issued on Jul. 9, 2002 to Carlson and U.S. Pat. No. 5,116,355 issued on May 26, 1992 to Freeman, III.

When the pile driving and the foundation raising operations are carried out from inside of a building, the pile must again be made of separate sections, new pile sections being added one by one to the upper end of the pile that is being gradually driven into the ground. Each pile section is fed from the top into the foundation lifting device and, as the overall height of typical lifting assemblies are about three to four feet and as the ceiling is less than eight feet high in a basement, each pile section is about three feet long such that it can be inserted from above into the pile driving mechanism of the lifting device. As each new pile section must be connected to the uppermost pile section of the pile, for instance by welding the pile sections together, the pile driving operation needs to be frequently interrupted thereby becoming time consuming.

SUMMARY OF THE INVENTION

Other objects, advantages and features of the present invention will become more apparent upon reading of the following non-restrictive description of specific embodiments thereof, given by way of example only with reference to the accompanying drawings.

It is therefore an aim of the present invention to provide a novel device for raising and supporting the foundation of a building.

It is also an aim of the present invention to provide a new pile assembly for such a device.

Therefore, in accordance with the present invention, there is provided a device for raising and supporting the foundation of a building, comprising a pile, a first assembly adapted to fixed to the foundation, a second assembly adapted to grip said pile to be inserted in the ground, actuating means adapted to draw said second assembly downwardly for driving said pile in the ground, said first assembly being adapted to guide said pile while said pile is driven in the ground by said second assembly and said actuating means, said pile being made of a series of longitudinally aligned pile sections that are connected together, wherein once a lower end of said pile has reached sufficient underground resistance, further actuation of the second assembly causes the foundation to be raised, wherein once the foundation has been raised to a desired position, said pile is fixed to at least one of said first assembly and the foundation thereby supporting the foundation in said desired position, and wherein said second assembly comprises a lateral access for allowing pile sections to be added to said pile by front loading in said second assembly.

Also in accordance with the present invention, there is provided a device for raising and supporting the foundation of a building, comprising a pile, a first assembly adapted to fixed to the foundation, a second assembly adapted to grip said pile to be inserted in the ground, actuating means adapted to displace said second assembly downwardly for driving said pile in the ground, said first assembly being adapted to guide said pile while said pile is driven in the ground by said second assembly and said actuating means, said pile being made of a series of longitudinally aligned pile sections that are connected together, wherein once a lower end of said pile has reached sufficient underground resistance, further actuation of the second assembly causes the foundation to be raised, wherein once the foundation has been raised to a desired position, said pile is fixed to at least one of said first assembly and the foundation thereby supporting the foundation in said desired position, and wherein said first assembly comprises a stirrup, a lifting mechanism and a connector for connecting said stirrup and said lifting mechanism together, said connector being adapted to displace said stirrup and said lifting mechanism relative to one another.

Further in accordance with the present invention, there is provided a device for raising and supporting the foundation of a building, comprising a pile, a first assembly adapted to fixed to the foundation, a second assembly adapted to grip said pile to be inserted in the ground, actuating means adapted to draw said second assembly downwardly for driving said pile in the ground, said first assembly being adapted to guide said pile while said pile is driven in the ground by said second assembly and said actuating means, said pile being made of a series of longitudinally aligned pile sections that are connected together, wherein once a lower end of said pile has reached sufficient underground resistance, further actuation of the second assembly causes the foundation to be raised, wherein once the foundation has been raised to a desired position, said pile is fixed to at least one of said first assembly and the foundation thereby supporting the foundation in said desired position, and wherein coupling sleeves are provided for connecting said pile sections together, said pile sections being hollow, each said coupling sleeve including a tubular member slidable in said pile sections and at least one boss outwardly extending from said tubular member for frictionally engaging said pile sections such as to secure said coupling sleeve to a pair of adjacent and longitudinally aligned pile sections.

Still further in accordance with the present invention, there is provided a method for raising and supporting the foundation of a building, comprising the steps of: (a) fixing a first assembly to the foundation; (b) front-loading a pile section into a second assembly located above said first assembly; (c) drawing said second assembly downwardly with said second assembly firmly gripping said pile section thereby driving said pile in the ground; wherein steps (b) and (c) are repeated with additional pile sections being added one by one in step (b), the longitudinally aligned-pile sections forming a pile extending into the ground, wherein once a lower end of said pile has reached sufficient underground resistance, further steps (c) causes the foundation to be raised, wherein once the foundation has been raised to a desired position, said pile is fixed to at least one of said first assembly and the foundation thereby supporting the foundation in said desired position.

Still further in accordance with the present invention, there is provided a method for displacing a footing of a foundation towards a wall of a building, comprising the steps of: (a) fixing a stirrup to the wall; (b) positioning a lifting mechanism under the footing; and (c) displacing said lifting mechanism towards said stirrup until the footing cannot be further displaced towards the wall.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF ILLUSTRATIVE EMBODIMENTS

Figure 1:
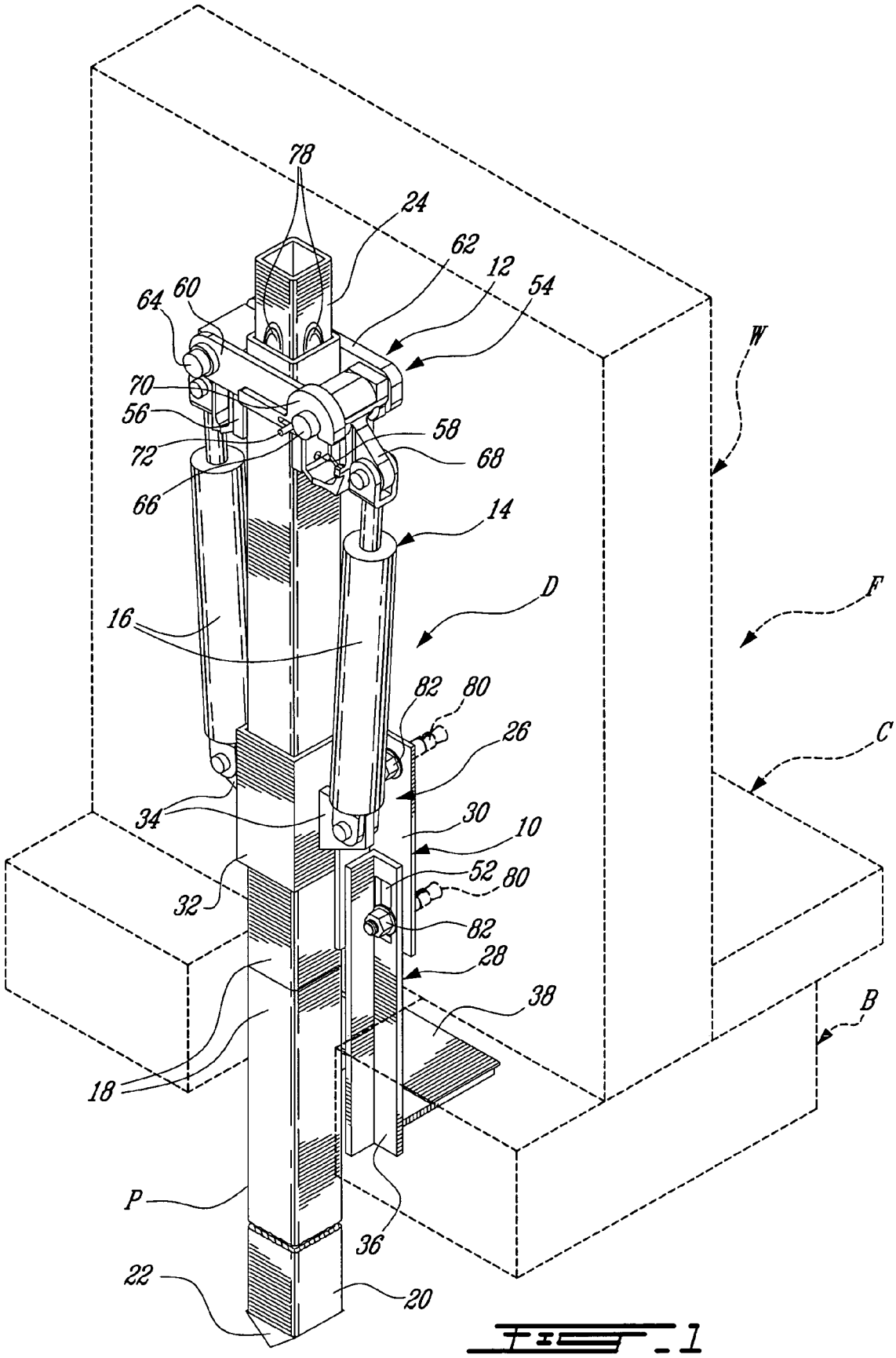
FIG. 1 is a perspective view of a device for raising and supporting the foundation of a building in accordance with the present invention, the structure of the building being shown in phantom lines and the device being shown in use from the outside of a building.

The present invention is illustrated in further details by the following non-limiting examples.

In accordance with the present invention, the appended drawings illustrate a device D for raising and supporting the foundation of a building, which generally has over time sunk into the ground so as to bring back the building to a level attitude. In the drawings, the foundation is identified by the reference F, this foundation F being generally made of concrete and comprising a horizontal footing B, a wall W extending upwardly from the footing B, and a concrete floor C extending within the foundation walls W and supported by the footing B.

The device D is adapted to first drive a pile P downwardly into the ground until it finds suitable resistance such that, in a following step, the device D raises the foundation F to a desired position, e.g. to a position where the foundation F and thus the building are substantially level. Therefore, the device D gradually drives the pile P into the ground and a continued action to do so once the pile P has reached the aforementioned sufficient resistance causes the foundation F to be raised by the device D.

To do so, the device D comprises a fixed assembly 10 adapted to be securely mounted to the foundation F, a mobile assembly 12 adapted to engage the pile P and downwardly drive the same into the ground, and an actuating system 14 for displacing the mobile assembly 12, the actuating system 14 herein including a pair of hydraulic cylinders 16 that are each connected at opposite ends thereof to the fixed assembly 10 and to the mobile assembly 12. The pile P is herein constituted of a series of longitudinally aligned pile sections 18 that are connected together. Each pile section 18 has herein a tubular shape, with a lowermost pile section 20 defining a point 22 at a lower end thereof for facilitating the insertion of the pile P into and through the ground. Such a pointed lowermost pile section 20 can be replaced by a pointed cap that is secured to a pile section 18. The pile sections 18 are connected together via a coupling sleeve 24 (to be described in more details hereinafter) in the form of a short tube slidably engageable into adjacent pile sections 18.

Figure 4:
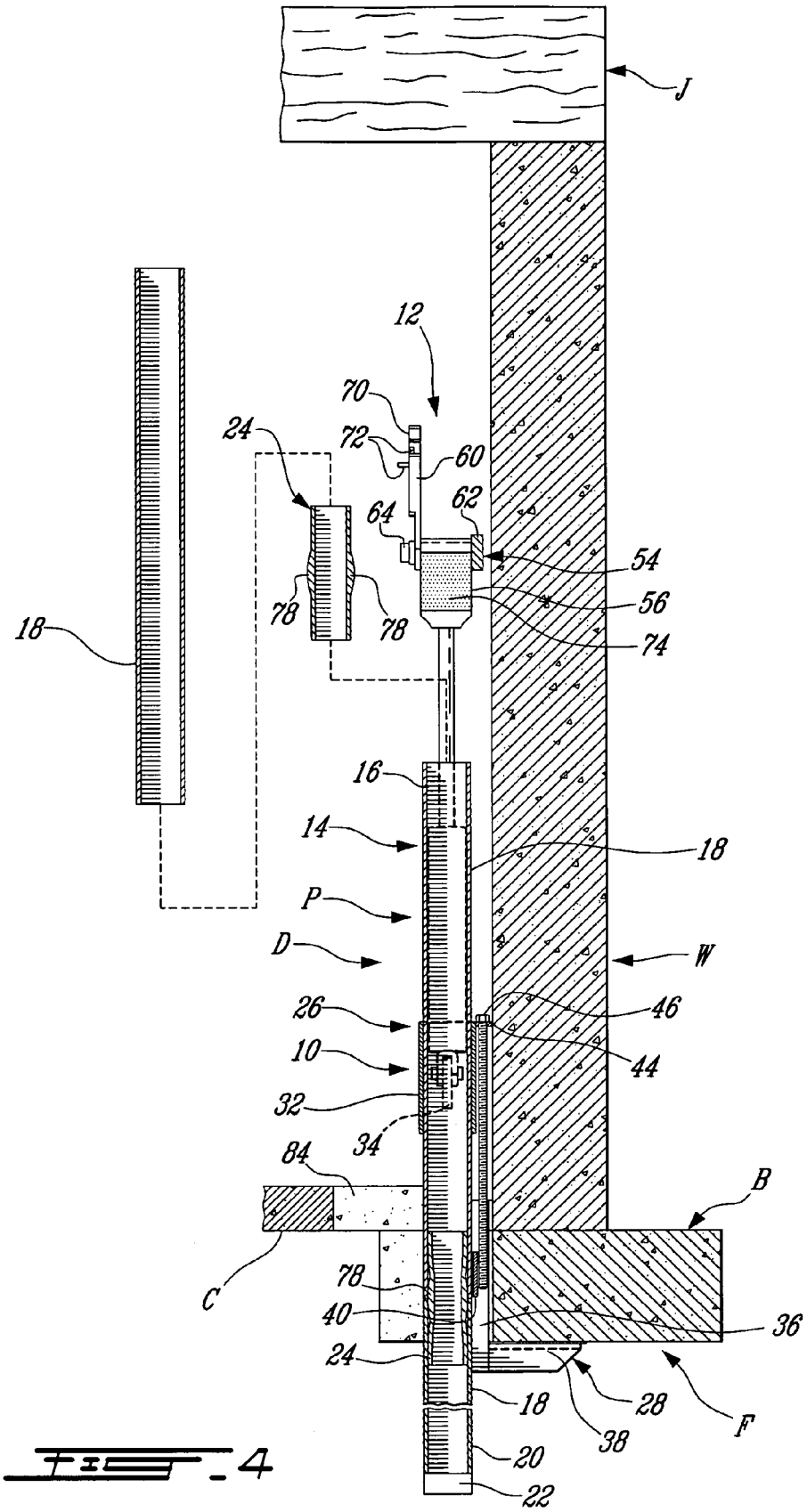
FIG. 4 is a vertical cross-sectional view of FIG. 2.
Figure 5:
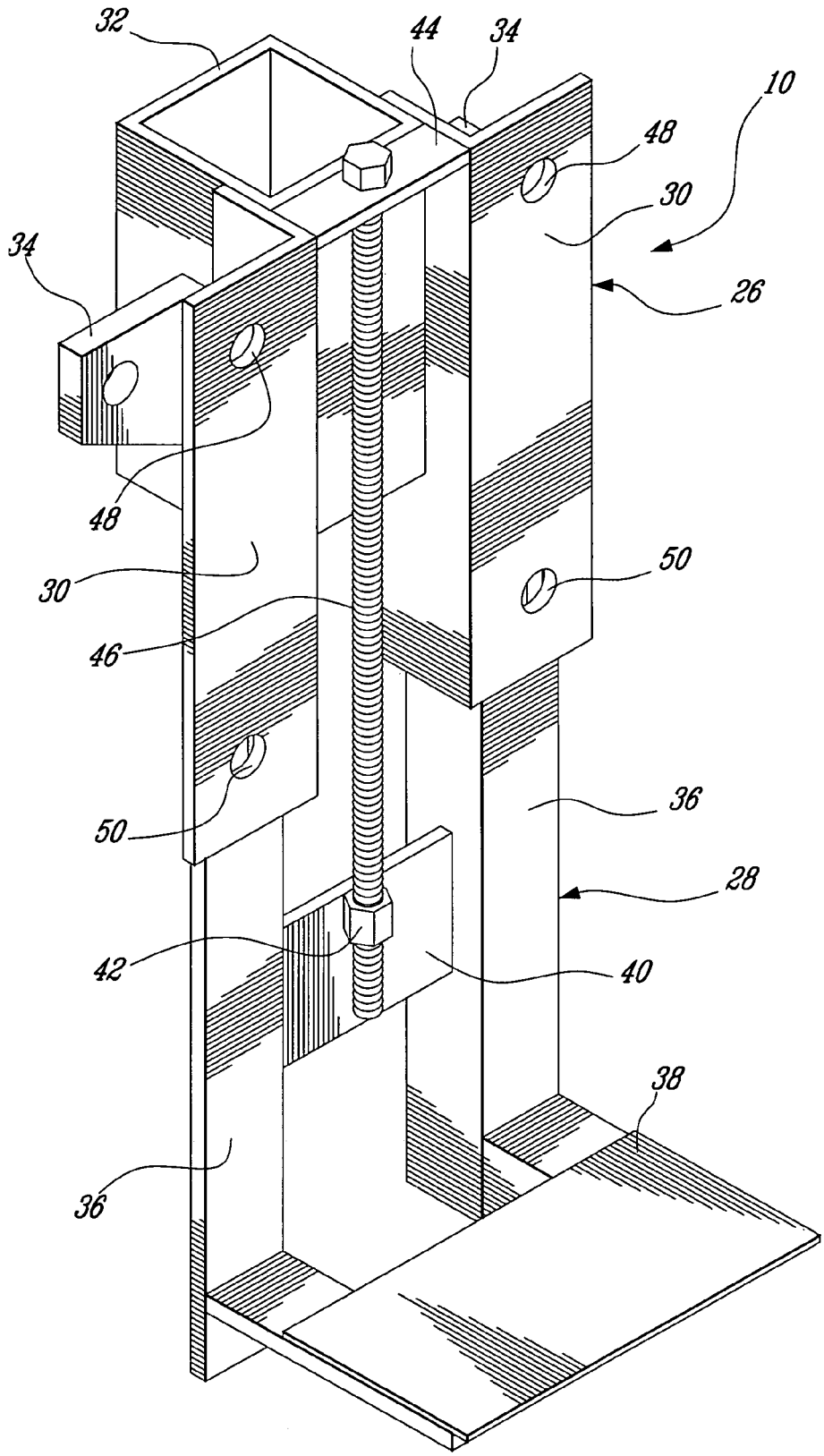
FIG. 5 is a rear perspective view of a stirrup and bracket assembly of the device of FIG. 1.

Generally, with reference to FIGS. 1, 2, 4 and 5, the fixed assembly 10 includes an upper stirrup 26 and a lower L-shaped leg 28, the fixed assembly 10 being well shown in isolation in FIG. 5. The stirrup 26 comprises a pair of vertical angle irons 30 that are spaced apart and that securely receive therebetween a vertical guide tube 32 that is adapted to slidably receive the pile P therethrough. A pair of laterally projecting wings 34 extends from opposite sides of the guide tube 32. The L-shaped leg 28 includes a pair of vertical and parallel angle irons 36 with a platform 38 extending at right angles from lower ends of the angle irons 36. A vertical plate 40 provided with a fixed nut 42 extends between the angle irons 36 in a fixed relationship.

A horizontal plate 44 extends between upper ends of the angle irons 30 of the stirrup 26, rearwardly of the guide tube 22 thereof. A bolt 46 extends through an opening (not shown) defined in the horizontal plate 44 and threadably engages the nut 42, as well seen in FIG. 5. The angle irons 30 of the stirrup 26 each define upper and lower holes 48 and 50, respectively. The upper ends of the angle irons 36 of the L-shaped 28 each define a slot 52, as best seen in FIG. 1, adapted to register with the lower holes 50 of the angle irons 30. The operation of the fixed assembly 10 will be described in details hereinafter.

Figure 2:
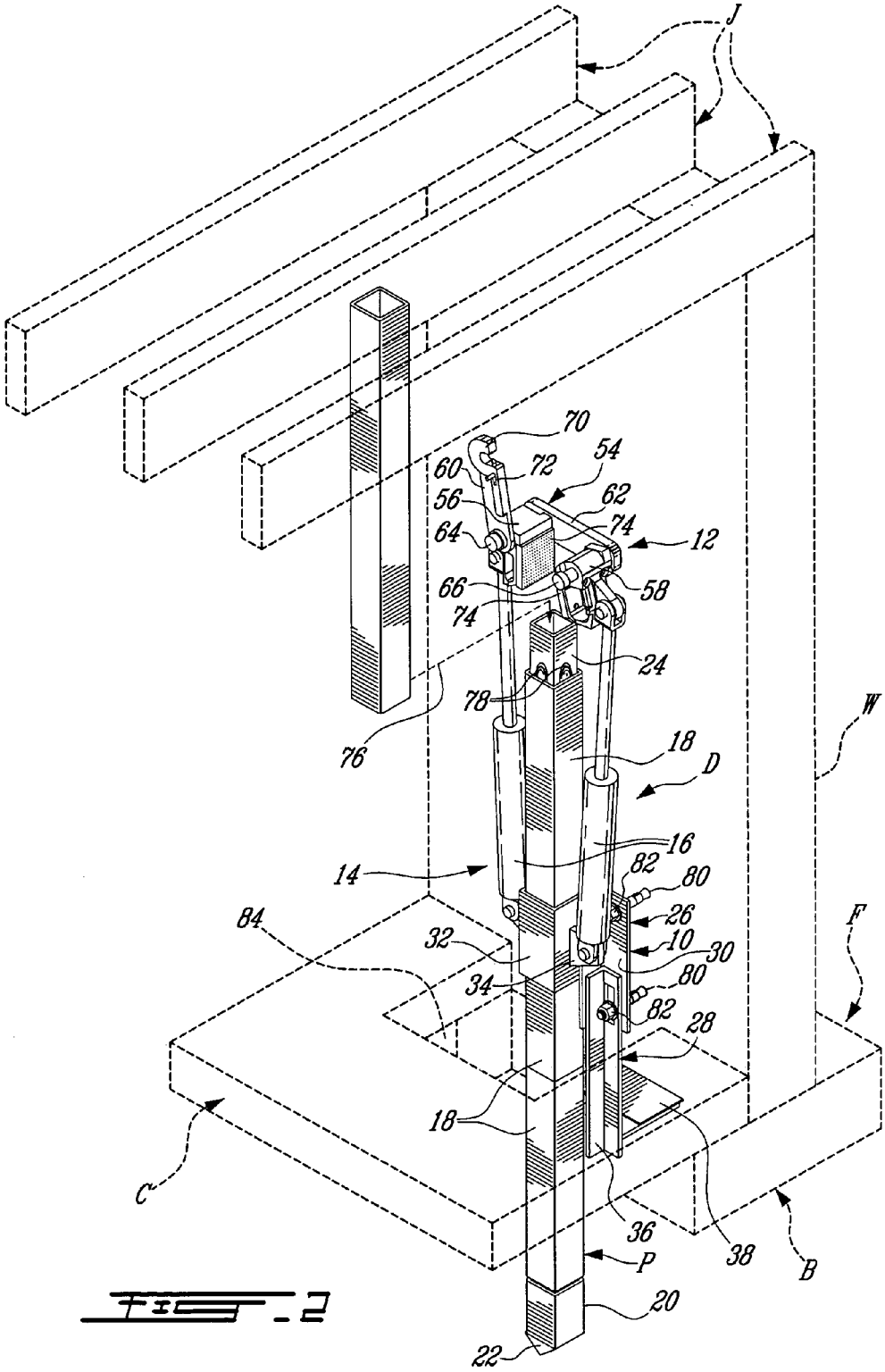
FIG. 2 is a perspective view showing the use of the device of FIG. 1 from inside of the building with a new pile section being added to the pile being driven into the ground.

Now turning to the structure of the mobile assembly 12, reference is made mainly to FIGS. 1 and 2, wherein it is apparent that the mobile assembly 12 comprises a frame 54, a fixed jaw 56, a mobile jaw 58 and a swing arm 60. The frame 54 includes a rear plate 62, and first and second pins 64 and 66, respectively, which extend laterally and horizontally from opposite ends of the rear plate 62. The fixed jaw 56 is fixedly mounted to the first pin 64, whereas the mobile jaw 58 is pivotally mounted around the second pin 66. Each of the fixed and mobile jaws 56 and 58 includes a laterally projecting wing 68 (see FIG. 3A).

The swing arm 60 is positioned in front of the fixed and mobile jaws 56 and 58, such that the swing arm 60, the rear plate 62 and the fixed and mobile jaws 56 and 58 form an enclosure adapted to surround the pile P. The swing arm 60 is pivotally mounted at a first end thereof to the first pin 64, whereas an opposed second end of the swing arm 60 includes a C-shaped member 70 which is adapted to engage the second pin 66, as seen in FIG. 1. A locking mechanism 72 is provided on the swing arm 60, this locking mechanism 72 being slidably displaceable towards the first pin 64 to an unlocked position for allowing the C-shaped member 70 to be disengaged from the second pin 66 and allowing the swing arm 60 to be pivoted to the position thereof shown in FIGS. 2 and 3A. The locking mechanism 72 assumes a locked position thereof when it is slid towards the C-shaped member 70 thereby sufficiently closing the C-shaped member 70 around the second pin 66 (as shown in FIG. 1) to prevent the swing arm 60 from accidentally displacing to its position shown in FIG. 2.

Figure 3A:
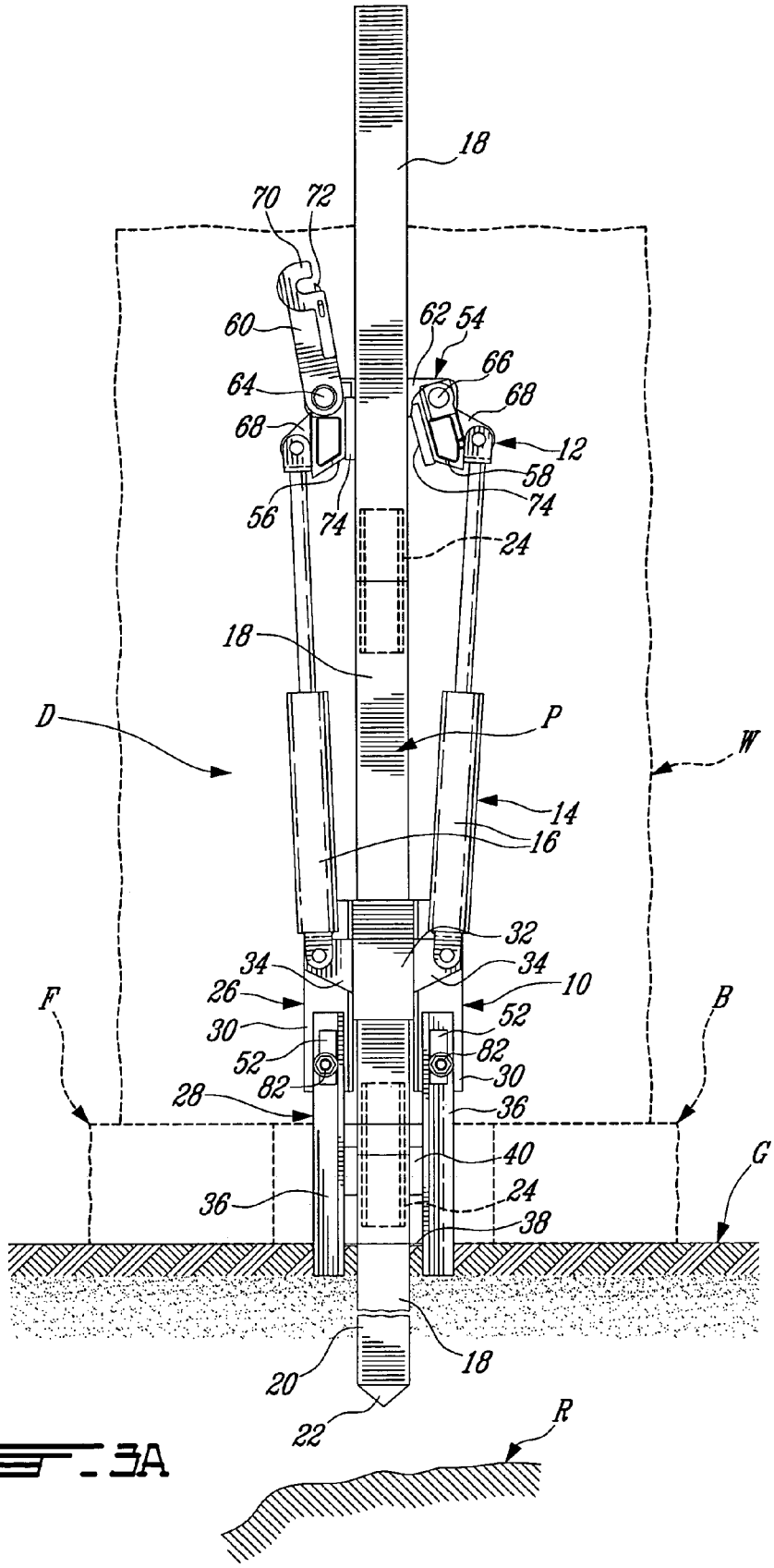
FIGS. 3A to 3D are successive elevational views showing one cycle of the pile driving operation from the positioning of a new pile section in the device of FIG. 1 to the insertion of the pile into the ground using the new pile section added thereto.

Each of the fixed and mobile jaws 56 and 58 includes a gripping surface 74, as best seen in FIGS. 2 and 3A. When the swing arm 60 is in its raised position shown in FIGS. 2 and 3A, a new pile section 18 can be added to the pile P by front loading, as indicated by arrow 76 in FIG. 2. Without the provision of the front access that results from the raising of the swing arm 60 on the mobile assembly 12, such a new pile section 18 would have to be top loaded from above the mobile assembly 12 thereby reducing the length of each pile section 18 being used, especially when the device D is used from the inside of a building (as illustrated in FIGS. 2 and 4), where there is limited overhead room in view of a ceiling of the basement where the device D is being used. Such a ceiling would, typically, lie atop the joists J shown in FIGS. 2 and 4.

The two hydraulic cylinders 16 are pivotally connected at lower ends thereof to the wings 34 of the stirrup 26 and at upper ends thereof to the wings 68 of the fixed and mobile jaws 56 and 58, as seen in FIGS. 1, 2 and 3A.

Figure 7:
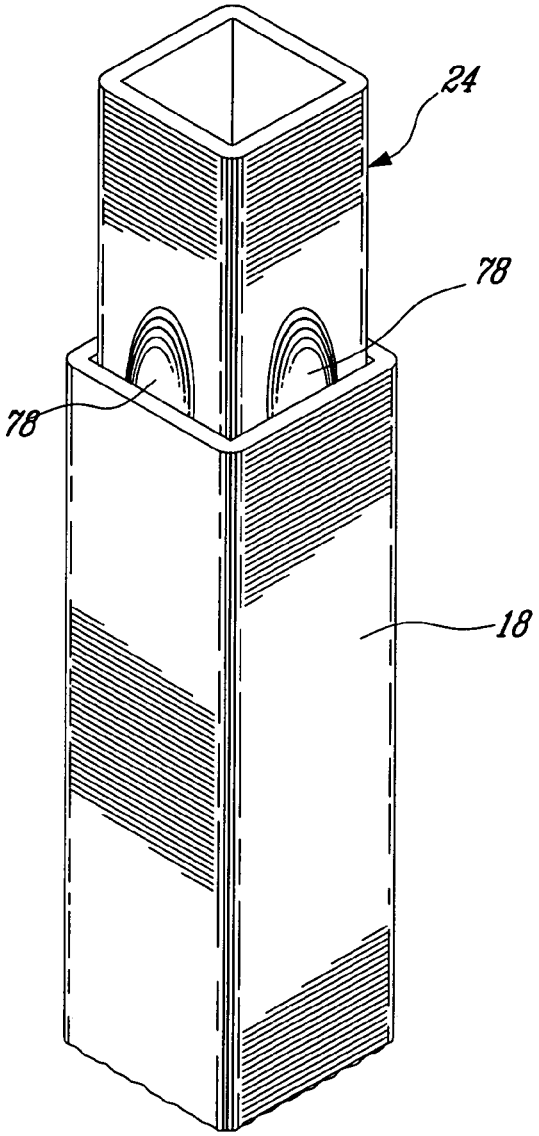
FIG. 7 is a perspective view of a coupling sleeve in accordance with the present invention, illustrated with a lower end thereof inserted in the upper end of a lower pile section.
Figure 8:
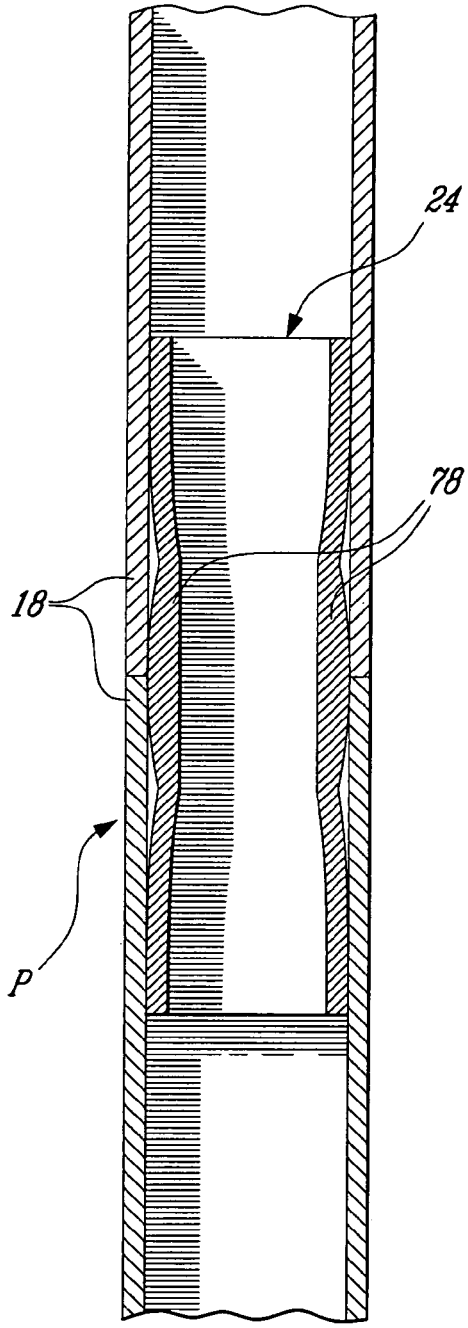
FIG. 8 is a vertical cross-sectional view showing the pile coupling sleeve of FIG. 7 firmly engaged to a pair of successive pile sections thereby connecting the same together.

Now referring to FIGS. 7 and 8, the coupling sleeve 24 includes typically on each side wall thereof an outwardly projecting, i.e. convex, boss that has, for instance, been defined by deforming the side walls of the coupling sleeve 24 via pressure applied from the inside of the coupling sleeve 24. The bosses 78 gradually increase the transversal dimensions of the coupling sleeve 24 thereby permitting a tight frictional fit of the coupling sleeve 24 to both the successive pile sections 18 that are engaged over the coupling sleeve 24 and that are being connected thereby.

The operation of the device D is as follows. First, if the footing B is properly in contact with the wall W and the concrete floor C (as is the case in FIGS. 1 and 2), the fixed assembly 10 is mounted to the wall W using headless anchor bolts 80 that have a threaded exposed end for receiving nuts 82. The anchor bolts 80 are inserted in the wall W at locations which are appropriate for allowing exposed threaded ends of the anchor bolts 80 to extend through the holes 48 and 50 of the angle irons 30 of the stirrup 26, with the lower two anchor bolts 80 also extending through the slots 52 of the angle irons 36 of the L-shaped leg 28. The platform 38 must be positioned, as best seen in FIG. 4, under the footing B. The use of the adjustment bolt 46 that link the stirrup 26 and the L-shaped leg 28 will be described hereinafter.

Once the fixed assembly 10 is properly secured to the wall W with the platform 38 thereof located underneath the footing B, as seen in FIG. 4, the pile driving operation can be initiated. Generally, the pile P is gradually inserted into the soil or ground G by subsequent extension and retractions of the hydraulic cylinders 16 with new pile sections 18 being added to the pile P, one by one, via a front loading of each pile section 18 into the mobile assembly 12. Obviously, depending on the length of each pile section 18 and the overhead clearance available above the mobile assembly 12 in its uppermost position (i.e. with the cylinders 16 fully extended as in FIG. 3A), the pile sections 18 can be top loaded into the mobile assembly 12, that is without having to open and close the swing arm 60 as it must be done when the pile sections 18 are fed into the mobile assembly 12 using the front loading option of the present device D.

In FIGS. 2 and 4, the pile driving operation (and the subsequent raising of the foundation F) is being carried out from inside of the building, whereby an opening 84 has been cut through the concrete floor C and in the footing B to allow for the installation of the fixed assembly 10 to the wall W and for the proper installation of the platform 38 under the footing B. It is noted that, in the case of FIGS. 1 and 3A to 3D where the device D is positioned on the outside of the wall W, the footing B may also have to be cut, where it extends outwardly of the wall W, to provide space for the fixed assembly 10.

Figure 3B:
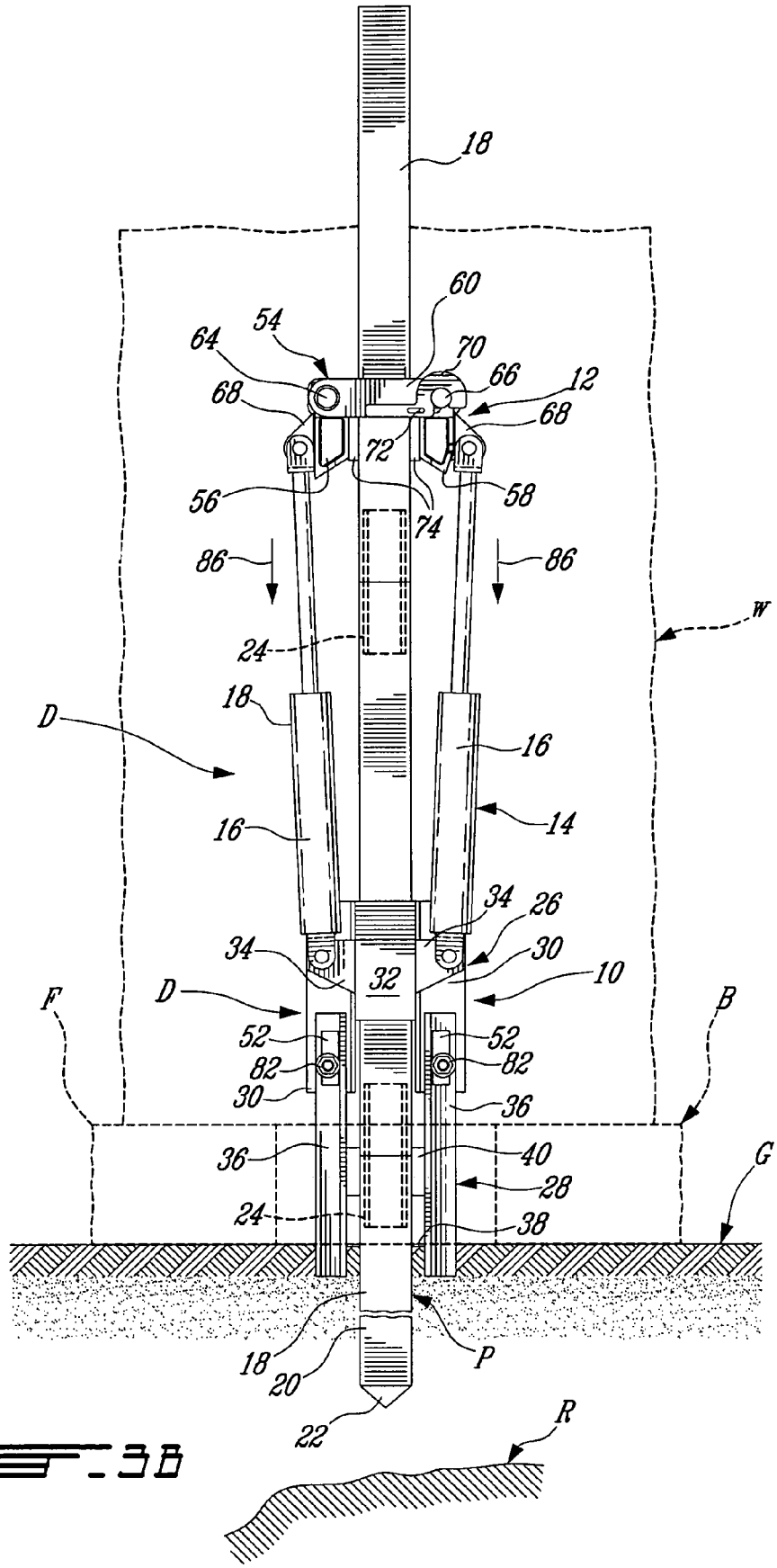

With the hydraulic cylinders 16 in their extended position and with the swing arm 60 in its closed position, as seen in FIG. 3B, initial retraction of the cylinders 16 along arrows 86, causes the mobile jaw 56 to pivot inwardly towards the fixed jaw 56 such that both the fixed and mobile jaws 56 and 58 engage opposed side walls of the pile P. Continued retraction of the cylinders 16 along arrows 88 (see FIG. 3C) results in the mobile assembly 12 further driving the pile P in the ground G. Once the cylinders 16 are in their retracted position, as shown in FIG. 3D, the cylinders 16 are extended with the mobile jaw 58 automatically pivoting outwardly out of engagement with the pile P such that the mobile assembly 12 can slide substantially freely upwardly along the pile P without any withdrawal of the pile P from the ground G.

Figure 3C:
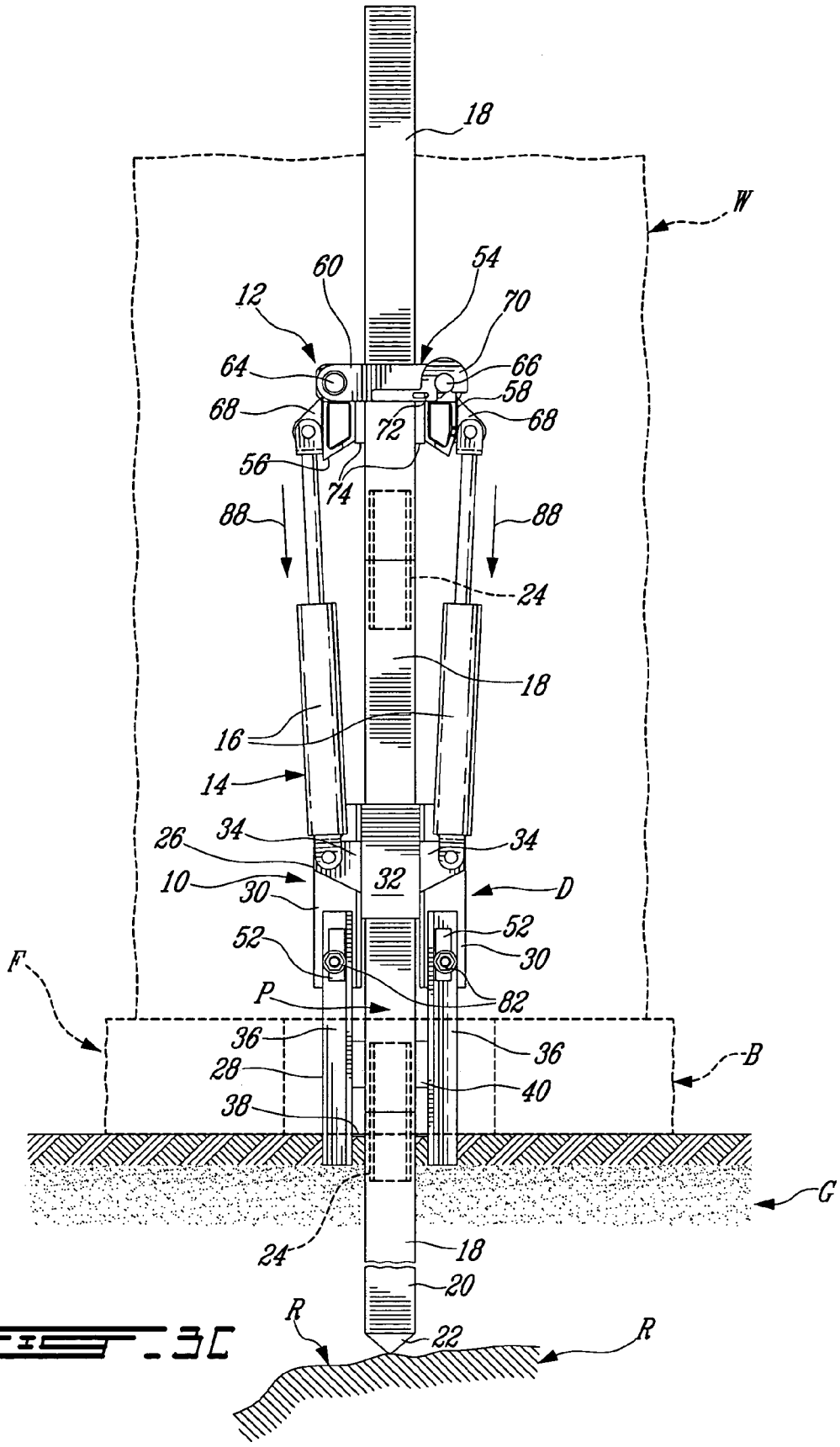
Figure 3D:
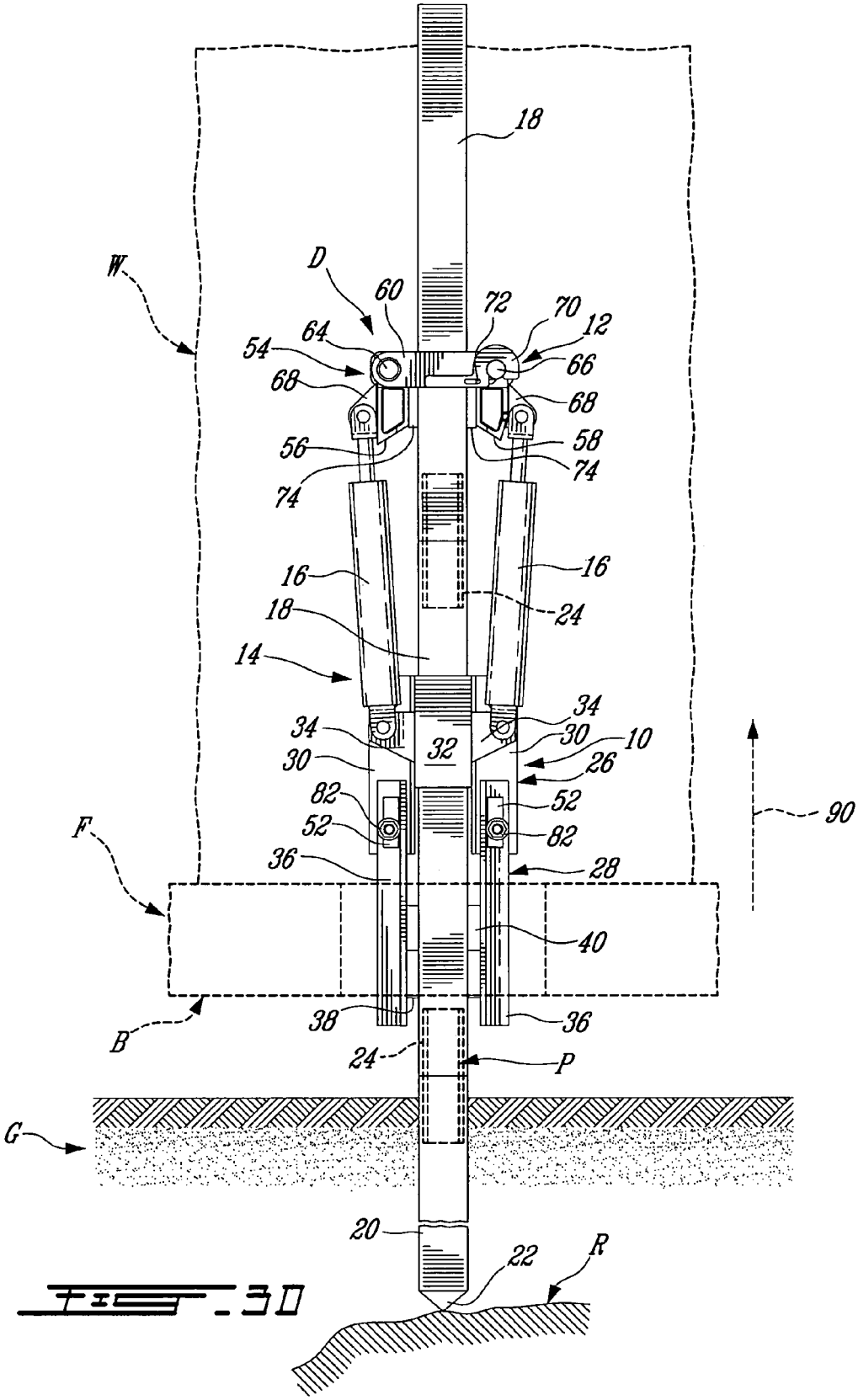

The cycle of FIGS. 3B to 3D is then repeated until the pile P cannot further be gripped by the mobile assembly 12. At that point, a new pile section 18 is added to the pile P either by front loading (see FIGS. 2, 3A and 4) or by top loading where possible, and is connected to the existing pile P via the coupling sleeve 24, as best seen in FIGS. 2 and 4. The cycle of FIGS. 3B to 3D can then be repeated and the addition of pile sections 18 to the pile P and the insertion of the pile P in the ground G is continued until the point 22 of the lowermost pile section 20 reaches sufficient underground resistance, such as a layer of bedrock R, as shown in FIGS. 3C and 3D.

Further retractions of the hydraulic cylinders 16 will then continue to attempt to displace the pile P downwardly. However, as the downward displacement of the pile P is now prevented by the bedrock R, continued retraction of the hydraulic cylinders 16 will cause the device D to raise the foundation F, as per arrow 90 in FIG. 3D. The hydraulic cylinders 16 are then extended and retracted until the foundation F has assumed a desired position, for instance when the building has become level.

At that point, the pile P is typically welded to the guide tube 22 of the stirrup 26 of the fixed assembly 10, the mobile assembly 12 and the hydraulic cylinders 16 are detached from the fixed assembly 10 (so that they can be reused), and the pile P is cut just above the guide tube 22. Therefore, only the fixed assembly 10 and the pile P remain permanently connected to the foundation F.

Generally, a number of devices D are positioned in a spaced apart manner along the foundation F, and are actuated synchronously to raise the foundation F to the desired position.

Each time a new pile section 18 is added to the pile P, a coupling sleeve 24 is used to connect the upper section of the pile P with the new pile section 18 being added thereto and which then becomes part of the pile P. This is well illustrated in FIGS. 2 and 4.

Figure 6A:
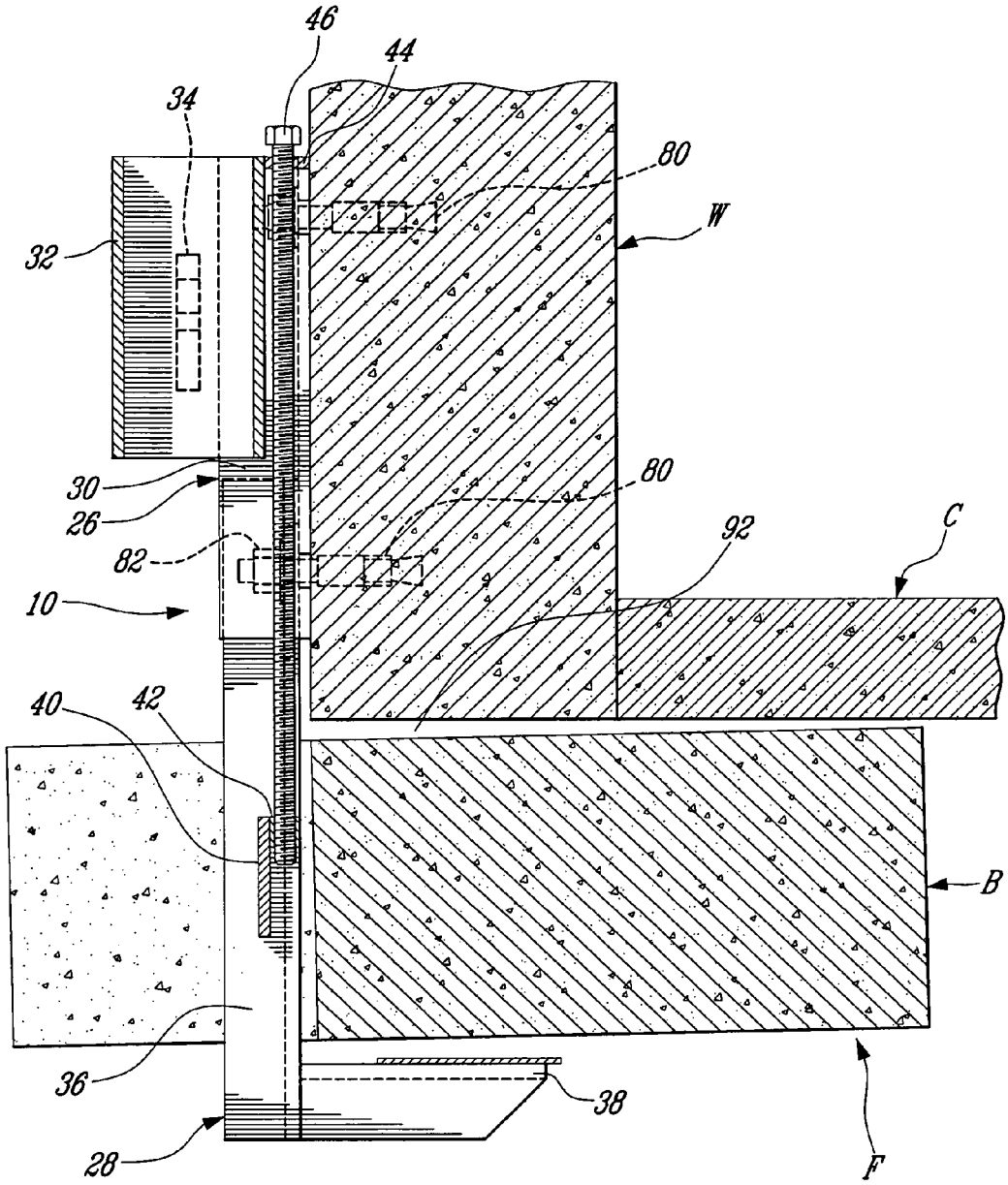
FIGS. 6A to 6C are vertical cross-sectional views showing subsequent positions of the stirrup and bracket assembly of FIG. 5 with respect to the building foundation.
Figure 6B:
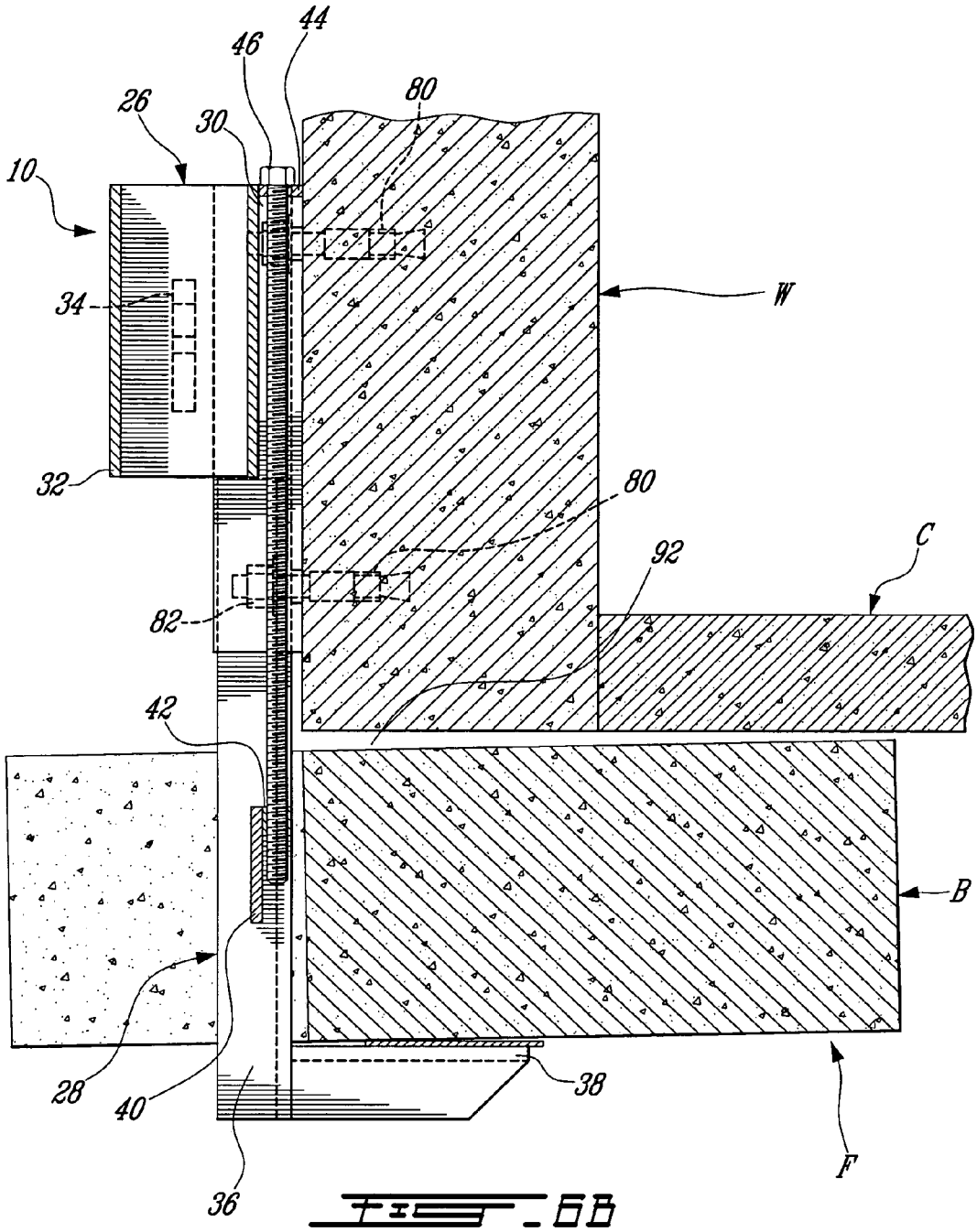
Figure 6C:
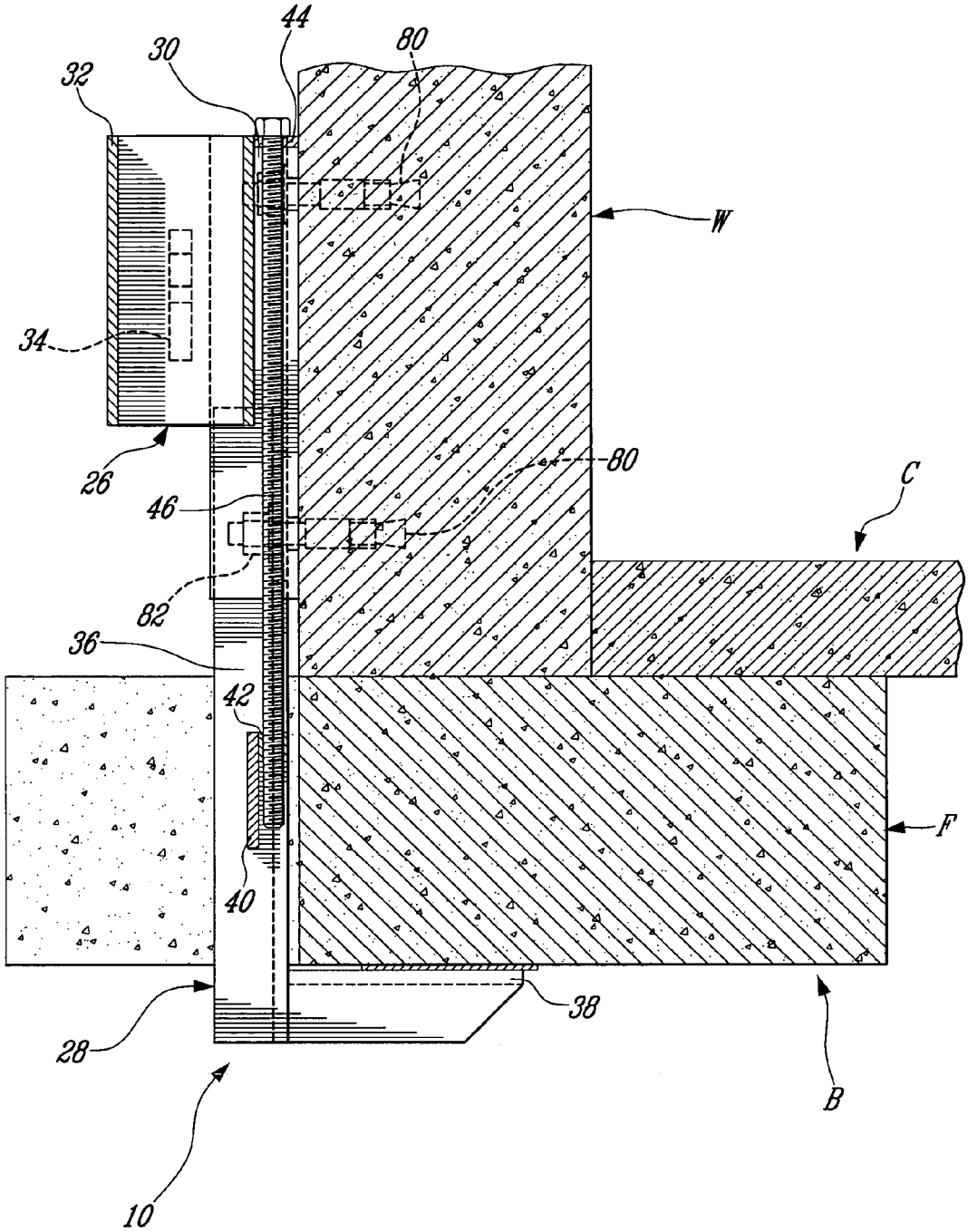

Now turning to the operation of the bolt 46 provided on the fixed assembly 10, reference is made to FIGS. 6A to 6C. When the footing B is not in full contact with the wall W and floor C (see gap 92 in FIG. 6A), it is desirable to first bring these structural building components together. This is done by securing the upper part of the stirrup 26 to the wall W using anchor bolts 80 and nuts 82 through the upper holes 48 of the angle irons 30. Two additional anchor bolts 80 are then inserted through the lower holes 50 and into the wall W. Nuts 82 are not, at that point, provided on the anchor bolts 80 that extend through the lower holes 50. The L-shaped leg 28 is then properly positioned with respect to the footing B, that is with the platform 38 being positioned under the footing B. Nuts 82 are then engaged on the threaded ends of the anchor bolts 80 that extend through the lower holes 50 and also through the slots 52 defined in the angle irons 36 of the L-shaped leg 28 (see FIG. 1), bearing in mind that these nuts 82 are not tightened so as to allow vertical sliding displacement between of the angle irons 36 relative to the angle irons 30 and thus between the stirrup 26 and the L-shaped leg 28.

The bolt 46 is then inserted through the hole defined in the horizontal plate 44 of the stirrup 26 and is threadably engaged in the nut 42 that is mounted to the vertical plate 40 of the L-shaped leg 28. Using generally a power driven socket, the head of the bolt 46 is engaged by such a socket and the socket is then rotated to rotate the bolt 46. As the stirrup 26 is fixed to the wall W by the anchor bolts 80 extending through the upper holes 48, the rotation of the bolt 46 causes a translational upward displacement of the L-shaped leg 28 such that the platform 28 engages the undersurface of the footing B, as seen in FIG. 6B. Further rotation of the bolt 46 causes a continued raising of the platform 38 and thus of the footing B (as the latter is forced upwardly by the platform 38) until the footing B engages the wall W and the concrete floor C, that is until the gap 92 has been substantially eliminated, as seen in FIG. 6C. Then, the nuts 92 that are engaged to the anchor bolts 80 that extend through the lower holes 50 and through the slots 52 are tightened thereby securing the complete fixed assembly 10 to the wall W with the footing B being retained against the wall W by the fixed assembly 10.

Accordingly, the device D of the present invention allows, with the front loading capability of new pile sections 18 in the mobile assembly 12, for the use of longer pile sections thereby increasing the efficiency of the overall pile insertion and foundation raising process. Also, in the present device D, the hydraulic cylinders 16 are conveniently positioned on each side of the pile P (as opposed to using overhead hydraulic rams) and under the mobile assembly 12 such that the pile driving operation is carried out by contraction of the cylinders 16 thereby eliminating any structural components, other that the upper end of the pile P, above the mobile assembly 12 and thus maximizing the length of the pile sections 18 being fed to the device D. This arrangement allows pile sections 18 of a length generally corresponding to the vertical distance between the upper end of the planted pile (i.e. above the guide tube 32 and below the uppermost position of the mobile assembly 12) and the ceiling to be front-loaded into the device D, e.g. pile sections 18 having 5 feet or more in length.

Furthermore, the relative displacement between the upper stirrup 26 and the lower L-shaped leg 28 of the fixed assembly 10 of the device D allows for the readjustment of the position of the footing B of the foundation F with respect to the wall W thereof before the pile driving and foundation raising operations are initiated thereby, not only permitting the building to be raised to a level attitude, but also to correct the position of some of the components of the foundation F.

Moreover, the use of the pressure fit coupling sleeve 24 to connect the pile sections 18 together is efficient in eliminating, for instance, the step of welding the pile sections 18 and their connectors together.

Although the present invention has been described hereinabove by way of specific embodiments thereof, it can be modified, without departing from the spirit and nature of the subject invention as defined in the appended claims.

What is claimed is:

1. A device for raising and supporting the foundation of a building, comprising:

a pile, a first assembly adapted to be fixed to the foundation, a second assembly comprising facing jaws and a pivotable arm, wherein at least one end of the arm is substantially C-shaped, actuating means adapted to draw said second assembly downwardly for driving said pile in the ground, said first assembly being adapted to guide said pile while said pile is driven in the ground by said second assembly and said actuating means, said pile being made of a series of longitudinally aligned pile sections that are connected together, wherein once a lower end of said pile has reached sufficient underground resistance, further actuation of the second assembly causes the foundation to be raised, wherein once the foundation has been raised to a desired position, said pile is fixed to at least one of said first assembly and the foundation thereby supporting the foundation in said desired position, wherein said pivotable arm is pivotable between a first position where an area between said facing jaws is accessible and a second position where said area is closed, a pile section that needs to be added to the pile being front-loaded into position atop the pile and between the facing laws when said arm is in said first position.

2. A device as defined in claim 1, wherein said actuating means comprise at least one hydraulic cylinder connected at a lower end thereof to said first assembly and at an upper end thereof to said second assembly such that when said pivotable arm is in said second position, said hydraulic cylinder is retracted and said second assembly is pulled downwardly thereby driving said pile in the ground.

3. A device as defined in claim 1, wherein said second assembly further comprises a frame for supporting said jaws.

4. A device as defined in claim 3, wherein said arm is mounted on said frame.

5. A device as defined in claim 4, wherein when said arm is in said closed position, said frame defines a closed structure with an opening therein through which said pile extends, said jaws being on opposed sides of said opening.

6. A device as defined in claim 5, wherein said frame includes a pair of pins each supporting one of said jaws, at least one of said jaws being pivotally mounted to a respective one of said pins.

7. A device as defined in claim 6, wherein said jaws include one fixed jaw and one mobile jaw, said mobile jaw being pivotally mounted to one of said pins.

8. A device as defined in claim 6, wherein said arm is pivotally mounted at one end thereof to a first one of said pins and is engaged at an opposed end thereof to a second one of said pins when in said second position.

9. A device as defined in claim 8, wherein said opposed end of said arm is partly open for receiving said second one of said pins.

10. A device as defined in claim 9, wherein a locking mechanism is provided for retaining in said closed position said arm engaged to said second one of said pins.

11. A device as defined in claim 1, wherein said first assembly comprises a stirrup, a lifting mechanism and a connector for connecting said stirrup and said lifting mechanism together, said connector being adapted to displace said stirrup and said lifting mechanism relative to one another.

12. A device as defined in claim 11, wherein said stirrup comprises a tubular guide though which said pile extends and at least one plate adapted to be fixed to a wall of the foundation, said lifting mechanism comprising a first section adapted to slide along the wall and a second section adapted to be positioned under a footing of the foundation.

13. A device as defined in claim 12, wherein said connector is adapted to displace said lifting mechanism towards said stirrup, whereby with said stirrup fixedly secured to the wall of the foundation and with said second section of said lifting mechanism extending under the footing of the foundation, operation of said connector elevates said lifting mechanism thereby raising the footing towards the wall, and wherein once the footing cannot be further displaced towards the wall, said first section of said lifting mechanism is secured to the foundation.

14. A device as defined in claim 13, wherein said connector comprises a nut fixed to said first section and a bolt extending through said stirrup with a head of the nut being prevented from moving downwardly by said stirrup such that rotation of said bolt draws said nut and thus said lifting mechanism upwardly towards said stirrup.

15. A device as defined in claim 12, wherein said first section of said lifting mechanism is adapted to slide along said plate of said stirrup.

16. A device as defined in claim 15, wherein said first section defines at least one vertical slot and said plate defines at least one hole, said slot and said hole being in register and anchor being adapted to extend through said slot and said hole and into the foundation for securing said first section of said lifting mechanism to the foundation once the footing cannot be further displaced towards the wall by said lifting mechanism.

17. A device as defined in claim 1, wherein coupling sleeves are provided for connecting said pile sections together, said pile sections being hollow, each said coupling sleeve including a tubular member slidable in said pile sections and at least one boss outwardly extending from said tubular member for frictionally engaging said pile sections such as to secure said coupling sleeve to a pair of adjacent and longitudinally aligned pile sections.

18. A device as defined in claim 17, wherein said pile sections and said tubular member of said coupling sleeve are of rectangular tubular configuration, said boss being provided on at least two opposed sides of said tubular member.

19. A device as defined in claim 18, wherein there is provided one said boss on each side of said tubular member.

20. A device for raising and supporting the foundation of a building, comprising:

a pile, a first assembly adapted to be fixed to the foundation, a second assembly comprising facing jaws and an arm pivotable between a first position where an area between said facing jaws is accessible and a second position where said area is closed to grip said pile to be inserted in the ground wherein at least one end of the arm is substantially C-shaped, actuating means adapted to displace said second assembly downwardly when said arm is in said second position for driving said pile in the ground, said first assembly being adapted to guide said pile while said pile is driven in the ground by said second assembly and said actuating means, said pile being made of a series of longitudinally aligned pile sections that are connected together, wherein once a lower end of said pile has reached sufficient underground resistance, further actuation of the second assembly causes the foundation to be raised, wherein once the foundation has been raised to a desired position, said pile is fixed to at least one of said first assembly and the foundation thereby supporting the foundation in said desired position, wherein said first assembly comprises a stirrup, a lifting mechanism and a connector for connecting said stirrup and said lifting mechanism together, said connector being adapted to displace said stirrup and said lifting mechanism relative to one another, and wherein a pile section that needs to be added to the pile is front-loaded into position atop the pile and between the facing jaws when said arm is in said first position.

21. A device as defined in claim 20, wherein said stirrup comprises a tubular guide though which said pile extends and at least one plate adapted to be fixed to a wall of the foundation, said lifting mechanism comprising a first section adapted to slide along the wall and a second section adapted to be positioned under a footing of the foundation.

22. A device as defined in claim 21, wherein said connector is adapted to displace said lifting mechanism towards said stirrup, whereby with said stirrup fixedly secured to the wall of the foundation and with said second section of said lifting mechanism extending under the footing of the foundation, operation of said connector elevates said lifting mechanism thereby raising the footing towards the wall, and wherein once the footing cannot be further displaced towards the wall, said first section of said lifting mechanism is secured to the foundation.

23. A device as defined in claim 22, wherein said connector comprises a nut fixed to said first section and a bolt extending through said stirrup with a head of the nut being prevented from moving downwardly by said stirrup such that rotation of said bolt draws said nut and thus said lifting mechanism upwardly towards said stirrup.

24. A device as defined in claim 21, wherein said first section of said lifting mechanism is adapted to slide along said plate of said stirrup.

25. A device as defined in claim 24, wherein said first section defines at least one vertical slot and said plate defines at least one hole, said slot and said hole being in register and anchor being adapted to extend through said slot and said hole and into the foundation for securing said first section of said lifting mechanism to the foundation once the footing cannot be further displaced towards the wall by said lifting mechanism.

26. A device for raising and supporting the foundation of a building, comprising:

a pile, a first assembly adapted to be fixed to the foundation, a second assembly comprising facing jaws and an arm pivotable between a first position where an area between said facing jaws is open and a second position where said area is closed to grip said pile to be inserted in the ground wherein at least one end of the arm is substantially C-shaped, actuating means adapted to draw said second assembly downwardly for driving said pile in the ground, said first assembly being adapted to guide said pile while said pile is driven in the ground by said second assembly and said actuating means, said pile being made of a series of longitudinally aligned pile sections that are connected together, wherein once a lower end of said pile has reached sufficient underground resistance, further actuation of the second assembly causes the foundation to be raised, wherein once the foundation has been raised to a desired position, said pile is fixed to at least one of said first assembly and the foundation thereby supporting the foundation in said desired position, and wherein coupling sleeves are provided for connecting said pile sections together, said pile sections being hollow, each said coupling sleeve including a tubular member slidable in said pile sections and at least one boss outwardly extending from said tubular member for frictionally engaging said pile sections such as to secure said coupling sleeve to a pair of adjacent and longitudinally aligned pile sections, and wherein a pile section that needs to be added to the pile is front-loaded into position atop the pile and between the facing jaws when said arm is in said first position.

27. A device as defined in claim 26, wherein said pile sections and said tubular member of said coupling sleeve are of rectangular tubular configuration, said boss being provided on at least two opposed sides of said tubular member.

28. A device as defined in claim 27, wherein there is provided one said boss on each side of said tubular member.

* * * * *